US005709232A

United States Patent [19]

Sheffler et al.

[11] Patent Number: 5,709,232

[45] Date of Patent: Jan. 20, 1998

[54] COSMETIC JAR AND STORAGE DEVICE

[75] Inventors: Robert J. Sheffler, Morganville, N.J.; Charles Chang, 127 E. Edsall Ave., Palisades Park, N.J. 07650

[73] Assignee: Charles Chang, Wayne, N.J.

[21] Appl. No.: 558,811

[22] Filed: Nov. 15, 1995

[51] Int. Cl.[6] ..... A45D 33/22

[52] U.S. Cl. ..... 132/295; 132/315; 206/581; 220/504

[58] Field of Search ..... 132/293, 294, 132/295, 297, 300, 315, 317; 206/581, 235, 823; 220/504, 524, DIG. 26

[56] References Cited

U.S. PATENT DOCUMENTS

| | | | |
|---|---|---|---|
| 1,472,350 | 10/1923 | Albanese | 206/235 |
| 1,501,525 | 7/1924 | Croswhite | 206/235 |
| 1,534,871 | 4/1925 | Roystone | 132/294 |
| 2,050,944 | 8/1936 | Greggains | 220/504 |
| 2,201,035 | 5/1940 | Gordon-Stables . | |
| 2,375,027 | 5/1945 | Naidech . | |
| 2,401,127 | 5/1946 | Younghusband | 132/293 |
| 2,446,080 | 7/1948 | Dennis | 132/293 |
| 2,449,196 | 9/1948 | Bent | 132/293 |
| 2,534,100 | 12/1950 | Baumgartner . | |
| 2,769,565 | 11/1956 | Sottile | 220/504 |
| 3,613,697 | 10/1971 | Andrews . | |
| 4,369,799 | 1/1983 | Napoleon | 132/294 |
| 4,777,969 | 10/1988 | Holloway | 132/314 |
| 5,180,084 | 1/1993 | Favre | 222/192 |
| 5,348,031 | 9/1994 | Cloud | 132/317 |
| 5,373,940 | 12/1994 | Hillelson | 206/385 |

FOREIGN PATENT DOCUMENTS

| | | | |
|---|---|---|---|
| 189744 | 10/1923 | United Kingdom | 220/DIG. 26 |
| 2152904 | 8/1985 | United Kingdom . | |
| 2179330 | 3/1987 | United Kingdom | 132/293 |
| 8703179 | 6/1987 | WIPO . | |

*Primary Examiner*—Todd E. Manahan

*Attorney, Agent, or Firm*—H. Gibner Lehmann; K. Gibner Lehmann

[57] ABSTRACT

A combined cosmetic jar and applicator storage device consisting of a structural body which provides a pair of back-to-back shallow recesses for holding a cosmetic material and an applicator, respectively. Two removable covers are carried by the body, one to close each of the recesses. The cover for one recess has a portion which telescopes into and is retained by a cooperable portion of the body, and has another portion consisting of a hinged flap which can be swung between open and closed positions to provide quick access to the applicator. Enhanced ease of use, coupled with improved function and an aesthetically pleasing physical appearance, are thus realizeable.

19 Claims, 4 Drawing Sheets

FIG. 10
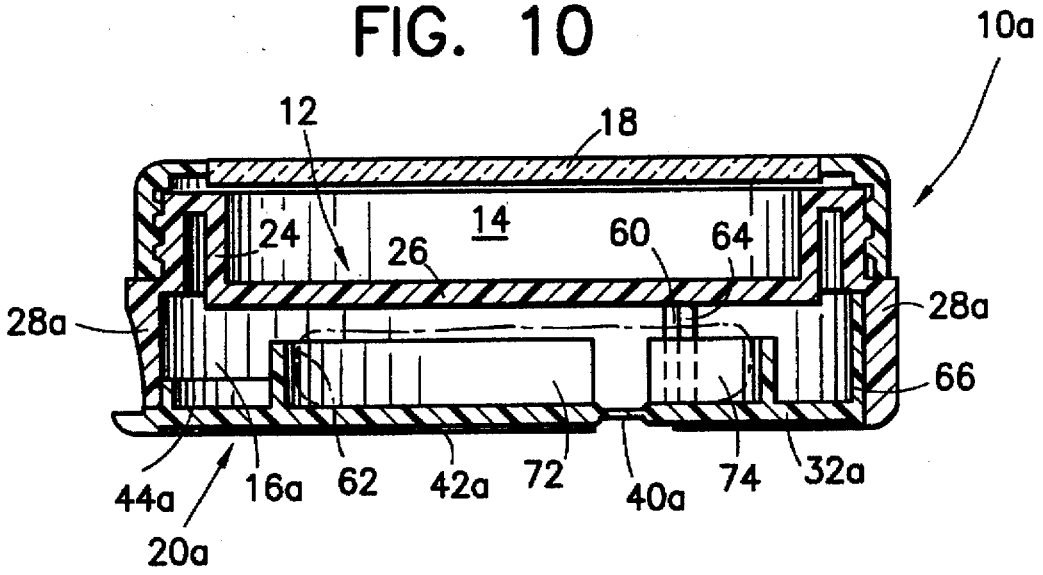
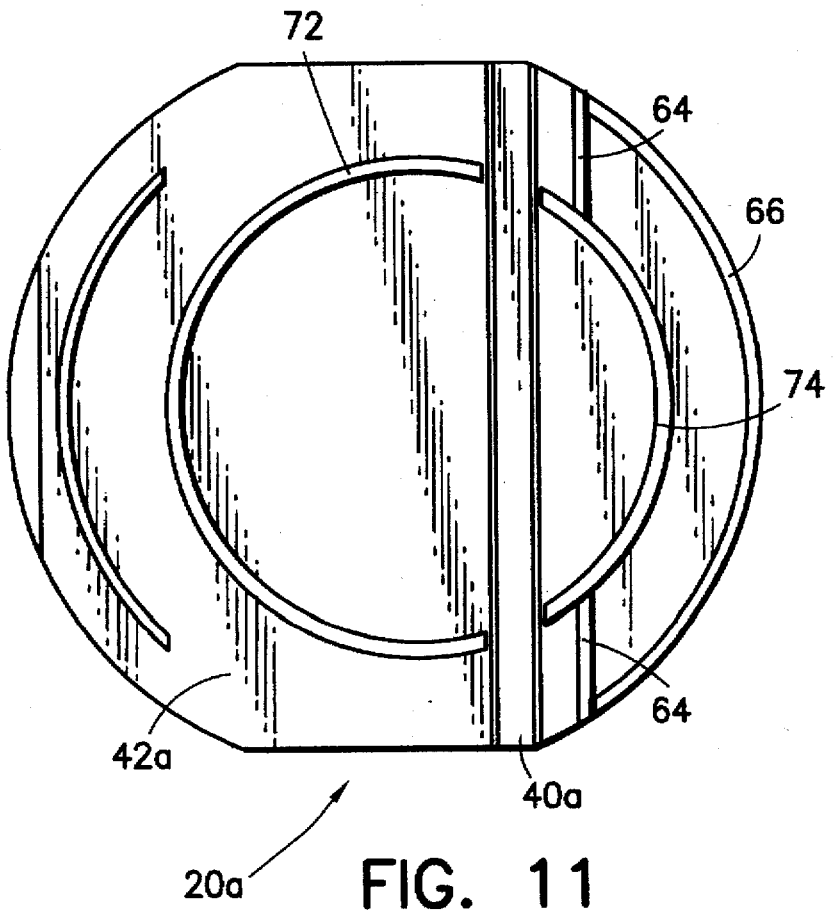
FIG. 11

COSMETIC JAR AND STORAGE DEVICE

NO CROSS REFERENCES TO RELATED APPLICATIONS

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to cosmetic dispensers, and more particularly to a class of devices commonly known in the trade as cosmetic "pots", which comprise small jars of varying sizes, that are typically fitted with continuous thread covers and which contain cosmetic substances such as rouges, pressed powders, balms, eyeliner/eyebrow coloring, and the like.

2. Description of the Related Art Including Information Disclosed Under 37 CFR Sections 1.97–1.99

The following references are indicative of some known, cosmetic dispensers of the type to which the present invention relates:

| U.S. Pat. Nos.: | | |
|---|---|---|
| 2,201,035 | 2,375,027 | 2,534,100 |
| 3,613,697 | 4,777,969 | 5,180,084 |
| 5,348,031 | 5,373,940 | |

PCT Published Application No. WO 87/03179

UK Published Application No. GB 2 152 904A

Several different cosmetic dispenser constructions are disclosed respectively, in U.S. Pat. Nos. 2,201,035; 2,375,027; and 2,534,100. No. '035 illustrates and describes a container having two product-carrying compartments and two brush applicators. No. '027 illustrates an elongated casing having multiple compartments for a cosmetic product, a brush, and a mirror, respectively, whereas No. '100 discloses a more conventional arrangement, involving a drawer-type structure having side-by-side compartments for a cosmetic material and an applicator brush, respectively.

More recent variations which have been devised are shown in U.S. Pat. No. 3,613,697, which illustrates a construction comprising an elongate casing having separate compartments, each containing a supply of cosmetic product and an applicator brush.

U.S. Pat. No. 4,777,969 and its counterpart PCT Application No. WO 87/03179, illustrate a twist-to-open cosmetic compact featuring separate compartments to hold a cosmetic substance and an applicator brush, respectively.

A somewhat similar twist-to-open container is shown in UK Published Application No. GB 2,152,904 A. Multiple compartments are provided, for holding a plurality of cosmetic substances, respectively. An applicator is also contained in the housing, and is rendered accessible as parts of the housing are turned with respect to one another, to a pre-determined angular position.

Still other cosmetic dispensers are the subjects of U.S. Pat. Nos. 5,180,084 and 5,348,031. Pat. No. '084 discloses a dispenser including a product reservoir and pump therefor, and an applicator brush, housed in a tubular casing having a hinged closure member. Pat. No. '031 illustrates a combined applicator and storage pan for a cosmetic substance.

Finally, U.S. Pat. No. 5,373,940 discloses a combined lipstick casing and elongate storage canister, for holding coins or other articles. The casing and canister are coaxial with one another, and the latter is shown as being fitted with a continuous thread closure cap.

Other arrangements of known cosmetic dispensers include: 1) variations on the drawer-type noted above, in which a slidable tray is exposed by sliding it out of a protective outer cover or housing; 2) a "stacked" or "double decker" type cosmetic dispenser having a flip-top closure and multiple tray-like structures that are hinged to one another and to the flip-top closure; and 3) a "treasure chest" type dispenser, which resembles a miniature chest of drawers, each drawer having a compartment for cosmetic substance and/or an applicator utensil.

Still another design involves a plurality of miniature jars which are "stacked" one upon another, and where the bottom wall of one jar constitutes a continuous thread lid for a second, and so-forth.

Cosmetic pots as currently manufactured generally take the form of simple, double-walled jars having continuous thread finishes, and fitted with screw caps. The double wall has an advantage in that the exterior of the pot can be made sufficiently large so as to be readily held and manipulated by the fingers, and at the same time providing a reduced-volume storage chamber for the cosmetic substance, which is usually needed in only minute quantities relative to the volume encompassed by the container's outer wall. The disadvantage is that such a double-wall jar can instead, create an undesirable, false impression to consumers. They often misconstrue the use of a double wall container as a purposeful deception on the part of the manufacturer, or a deliberate attempt to misrepresent the actual amount of product being supplied in the container.

While some of the cosmetic dispensers noted above have been commercialized, efforts are continuously under way toward achieving improved economy of manufacture, improved ease of use, and greater consumer appeal.

In particular, one of the problems typically encountered is that of easily storing and protecting the cosmetic applicator, and in a manner that renders the applicator readily accessible, but without disturbing materially, the aesthetics of the overall product.

Also, consideration must be given to adequate isolation of the applicator when not in use, to minimize inadvertent contamination. In particular, special care is required while applying cosmetic material to the face, especially to areas around the eyes, as in the case of eyelid liner and eyebrow liner. The issue of avoiding possible contamination of a product or applicator brush used therewith is an important factor which must be addressed, in the production of any cosmetic dispenser.

A related consideration is that of avoiding inadvertent spillage of the dispenser contents, which might otherwise lead to soiling of clothing or furniture. Ease of manipulation and use of the applicator is also important, thereby reducing the possibility of its being inadvertently dropped by the consumer.

SUMMARY

Accordingly, it is one object of the present invention to provide an improved cosmetic jar and storage device which is simple in its structure and at the same time convenient to use, retaining essentially the same, familiar look and feel of a conventional cosmetic jar or "pot" of the type currently in widespread use.

A related object of the invention is to provide an improved cosmetic jar and storage device as above set forth, which provides improved resistance to inadvertent contamination of the jar contents and applicator therefor, and less tendency for inadvertent soiling of clothing from accidental contact with the applicator.

Still another object of the invention is to provide an improved cosmetic jar and storage device as above characterized, which is constituted of relatively few separate components that can be readily molded in simple mold cavities, so as to keep the manufacturing cost as low as possible.

Yet another object of the invention is to provide an improved cosmetic jar and storage device of the kind indicated, which is especially easy for the consumer to manipulate and use, thereby enhancing the marketability of the device.

A still further object of the invention is to provide an improved cosmetic jar and storage device in accordance with the foregoing, which is aesthetically pleasing in its appearance, again enhancing the overall eye-appeal and marketability of the device.

These and other objects are accomplished by a cosmetic jar and applicator storage device comprising in combination, a structural body providing a pair of back-to-back shallow recesses, removable cover means carried by the body, enclosing one of the recesses to retain cosmetic substance therein, and a second cover means carried by the body, enclosing the other of the recesses to retain an applicator therein. The second cover means has an anchorage portion attached to the body, and a closure flap connected to the anchorage portion by a thin, resilient integral hinge. The closure flap has detent means cooperable with detent means carried by the body, for yieldably holding the flap in a closed position wherein it closes the other of the shallow recesses.

The arrangement is such that the applicator, when stored, is maintained in a closed compartment which is separate and apart from that of the cosmetic product. The applicator can be readily accessed by the consumer, who merely lifts a closure flap with his fingernail, and folds the flap back an extent, to expose the applicator. Following use, the applicator can be readily re-inserted and the closure flap returned to its normal, closed position.

The jar and applicator storage device features a reduced number of separate components, all of which can be economically molded. Thereafter the parts can be easily assembled, and the jar filled with the intended cosmetic product. Introduction of the applicator utensil into its own compartment is similarly readily accomplished.

As a consequence, a highly functional and aesthetically pleasing cosmetic dispenser is realized, with low overall manufacturing cost, and use of minimal quantities of plastic raw material.

Other features and advantages will hereinafter appear.

BRIEF DESCRIPTION OF THE DRAWINGS

In the drawings, illustrating several embodiments of the invention:

FIG. 10 is an axial section of a modified jar and storage device for use with a powder-puff type applicator, constituting another embodiment of the invention, and FIG. 11 is a top plan view of the second cover means of the jar and storage device of FIG. 10.

DESCRIPTION OF THE PREFERRED EMBODIMENTS

Figure 1:
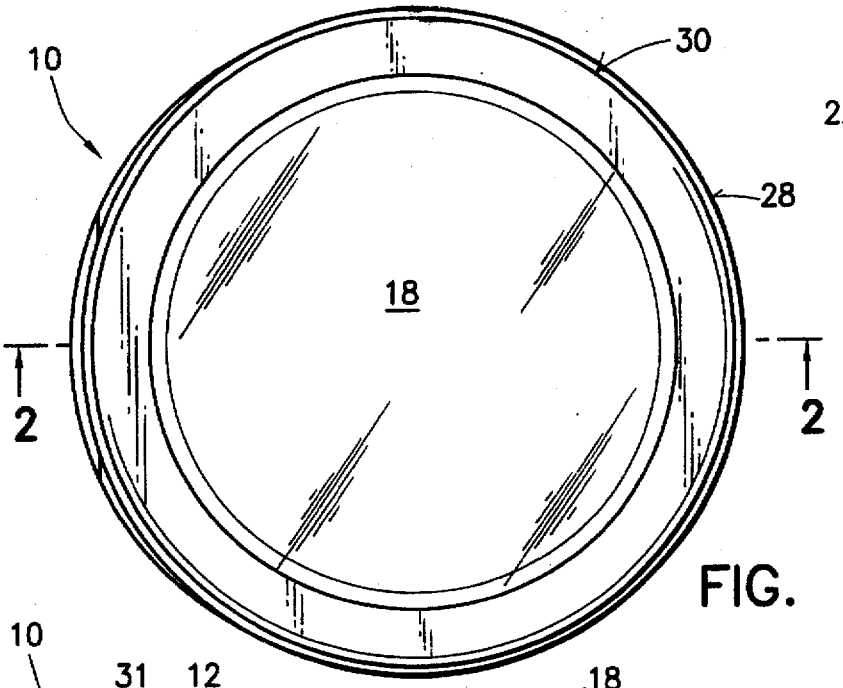
FIG. 1 is top plan view of the improved cosmetic jar and applicator storage device of the present invention.
Figure 7:
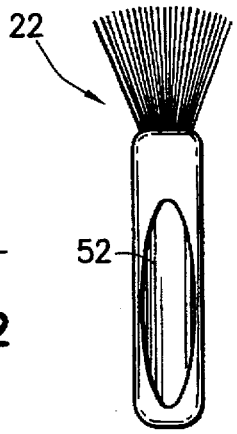
FIG. 7 is a top plan view of an applicator brush as employed with the jar and storage device of the present invention.
Figure 2:
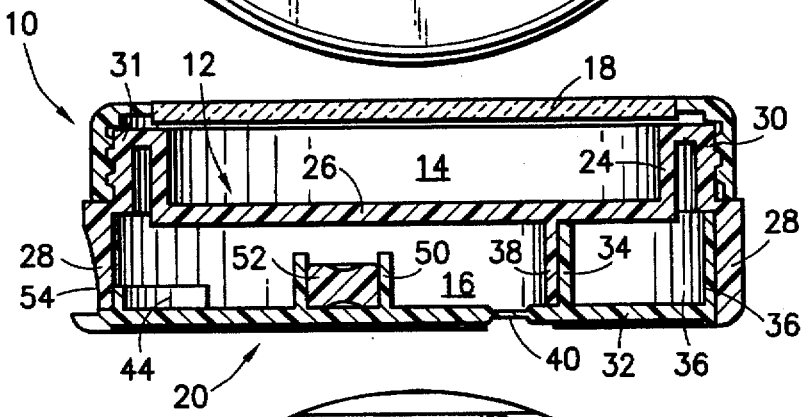
FIG. 2 is an axial section of the jar and storage device taken on the line 2—2 of FIG. 1, and particularly illustrating first and second removable cover means for enclosing two recesses respectively, of the device.
Figure 3:
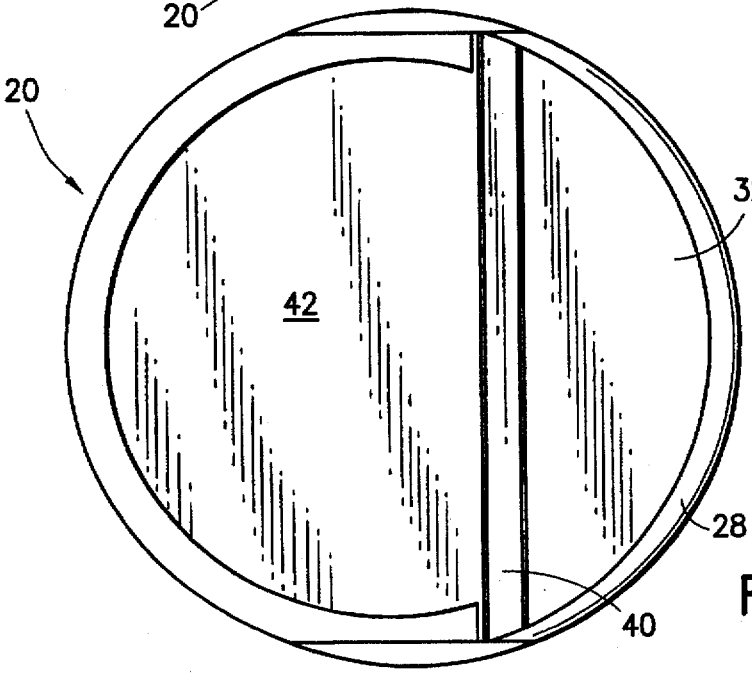
FIG. 3 is a bottom plan view of the jar and applicator storage device of FIGS. 1 and 2.

Referring first to FIGS. 1–3, and in accordance with the present invention there is provided a novel and improved molded plastic cosmetic jar and applicator storage device generally designated by the numeral 10, comprising a structural body 12 of generally cylindrical configuration, and having a pair of back-to-back shallow recesses 14, 16 which are covered by removable cover means 18, 20 respectively, one recess 14 being adapted to carry a quantity of cosmetic substance and the other recess 16 accommodating an applicator 22, FIG. 7. The upper recess 14 is defined by an annular wall 24 and a transverse bottom wall 26. The lower recess 16 is similarly formed by a second annular wall or depending peripheral skirt 28, the transverse wall 26 being common to both recesses 14 and 16 and sealing them from each other. The lower recess 16, along with its cover means 20, defines an applicator storage compartment.

On the body structure 12, surrounding the annular wall 24 is another or outer annular wall 30, spaced from wall 24 so as to form a rim portion 31 of U-shaped cross-section. On the exterior or outer periphery of wall 30 are continuous threads to mate with cooperable continuous threads on the respective cover means 18, which in the present case is a screw cap or closure member providing a screw-tight seal. Such a closure member can optionally have a central panel of transparent or semi-transparent material as shown in FIG. 2, which enables the cosmetic product in the upper recess 14 to be viewed from above the jar, with the cover means 18 closed.

Figure 4:
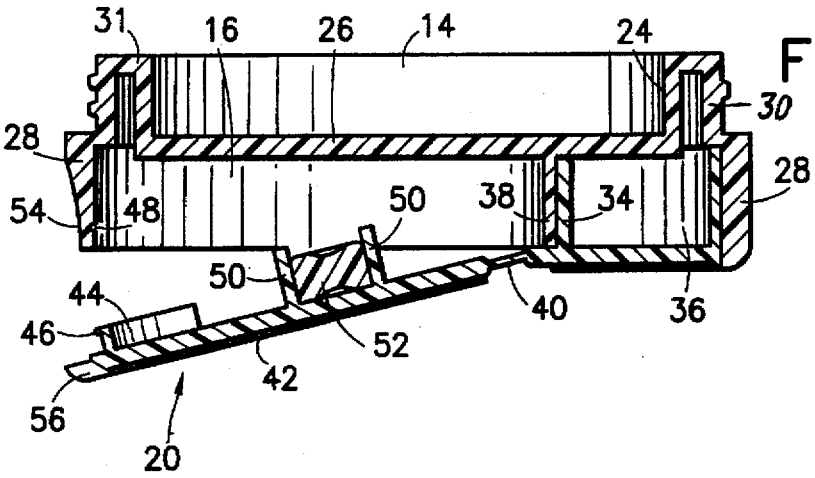
FIG. 4 is an axial section similar to FIG. 2, showing the second cover means of the jar and storage device disposed in an intermediate position, between its closed and open positions.
Figure 5:
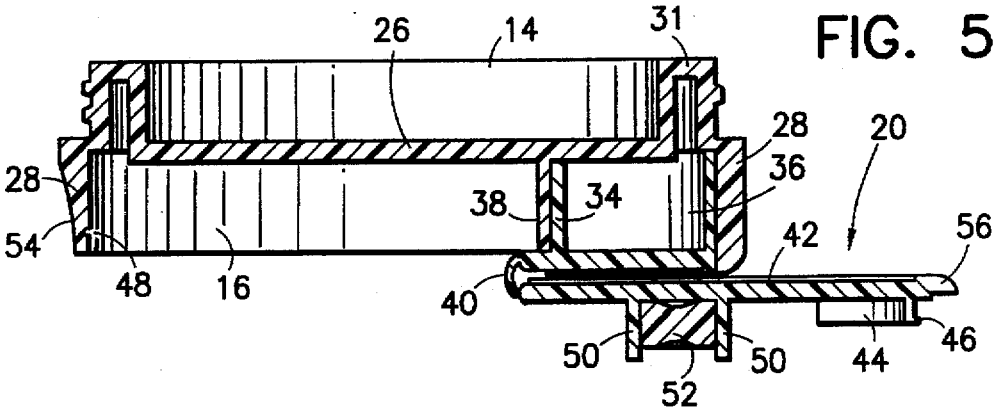
FIG. 5 is an axial section like FIGS. 2 and 4, except showing the second or lower cover means of the jar and storage device disposed in a fully open position.
Figure 8:
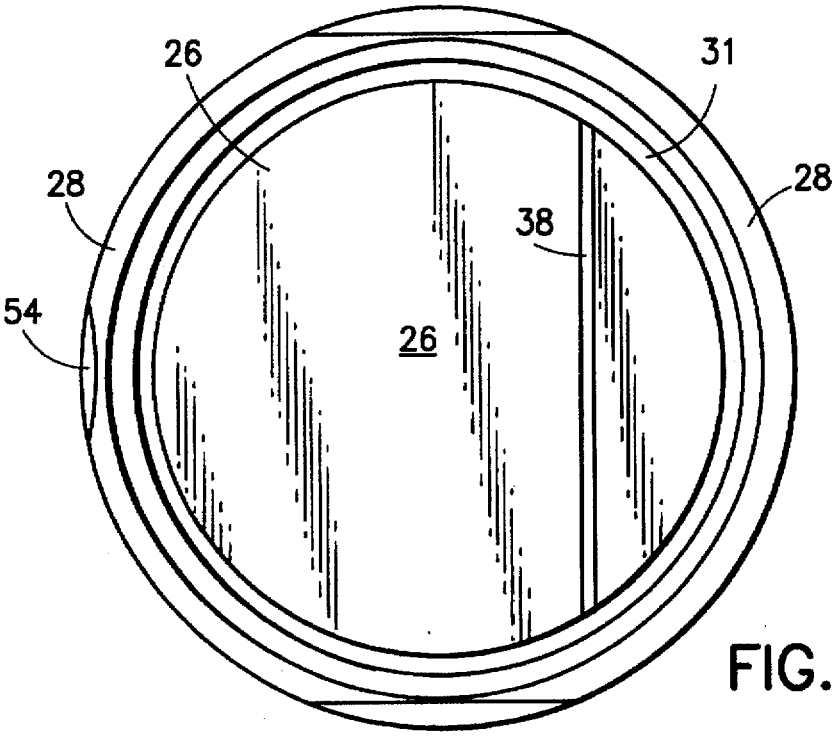
FIG. 8 is a bottom plan view of the body of the jar and storage device of FIGS. 1–6.
Figure 9:
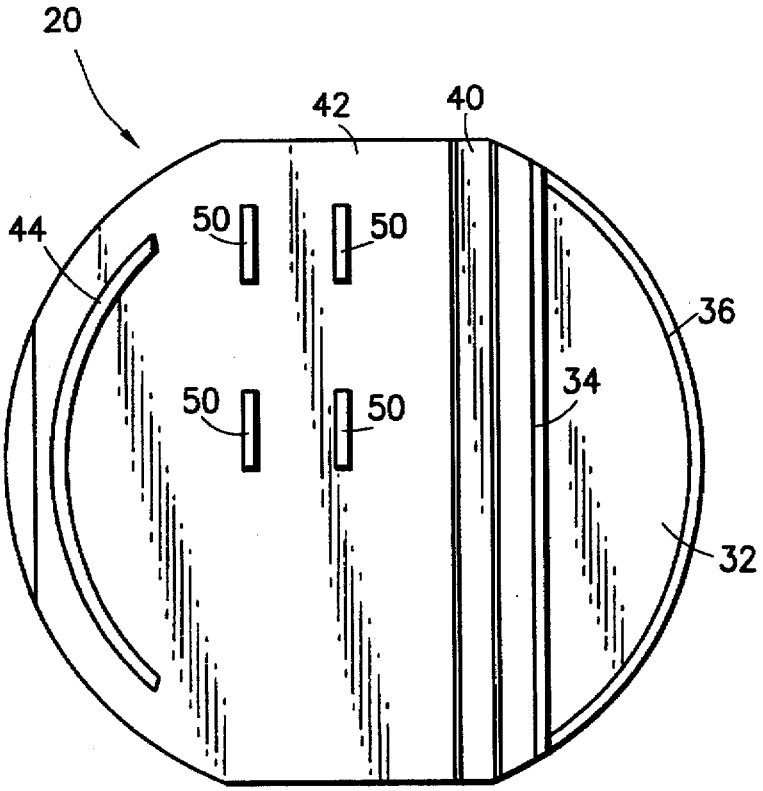
FIG. 9 is a top plan view of the second or lower cover means of the jar and storage device of FIGS. 1–6.

Further, by the invention and as shown in FIGS. 2 and 9 the second or lower cover means 20 for the lower recess 16 includes an anchorage or retainer portion comprising a bottom wall 32, and an upstanding, open-top enclosure comprising a straight wall portion 34, and a cylindrical wall segment 36, spaced from the straight portion 34. There is provided on the body 12 at its under side, a downwardly facing open polygonal socket formed in part by a depending wall portion or segment 38, FIGS. 2 and 8, integral with the transverse wall 26, and in part by a portion of the annular wall 28, such that the anchorage portion of the cover means can be telescopically fitted into the socket of the body, with a press-fit, as shown in FIGS. 2, 4 and 5. Optionally, suitable adhesive can be applied to the telescoping portions, following the telescopic fit, so as to insure adequate retention of the parts.

As particularly shown in FIG. 9, the second cover means 20 is of generally circular configuration or outline.

Further, in accordance with the invention the second cover means 20 comprises a thin, polyolefin resilient, integral or living hinge 40 and a flap 42 that is movable with respect to the anchorage portion 32, 34 and 36, and which can be manually swung downwardly from the closed position shown in FIG. 2, past an intermediate position shown in FIG. 4, toward a fully open position as in FIG. 5. The hinge 40 lies along a chord of the generally circular second cover means 20, shown in FIG. 9, and the flap 42 is provided with a detent means comprising an upstanding arcuate or crescent-shaped skirt 44 having an external detent bead 46, FIGS. 4 and 5, which is receivable in a corresponding internal groove 48 on the annular wall 28 of the body 12 when the flap 42 is in the closed position. The arrangement is such that the flap 42 is normally retained in this position during storage and shipping of the cosmetic jar and applicator.

Figure 6:
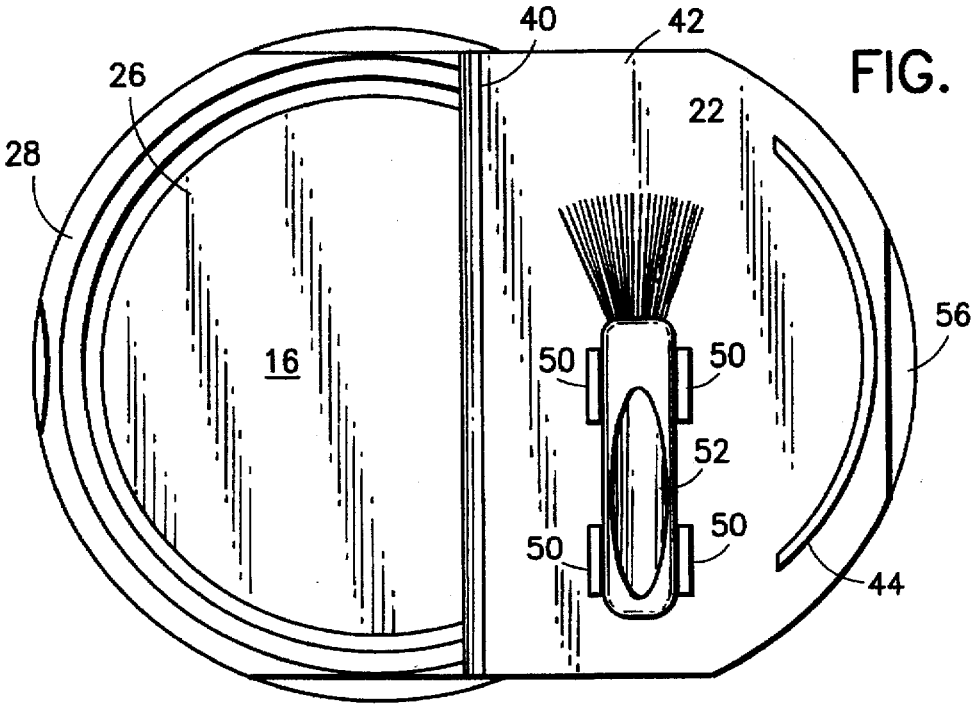
FIG. 6 is a bottom plan view of the jar and applicator storage device, with the second cover means thereof shown in an open position.

Further by the invention, there is provided on the inner surface of the flap 42, a support for the applicator or brush 22, shown particularly in FIG. 7, the said support comprising a plurality of resilient retainer lugs or tabs 50, FIGS. 6 and 9, which are arranged to frictionally grip the handle portion 52 of the applicator or brush 22. In the illustrated embodiment, a total of four such lugs 50 is utilized.

Preferably there is also provided a relief 54 on the outer surface of the annular wall 28, forming a clearance space for the user to insert a fingernail against the underside of the flap 42, to facilitate opening the applicator compartment. In addition, the edge of the flap 42 at the location of the relief 54 is preferably bevelled, constituting a finger tab 56, FIGS. 4–6, and as shown the tab can be arcuate in order to facilitate opening.

With such an arrangement, access to the upper recess 14 is readily accomplished by merely unscrewing the closure cap 18, to expose the cosmetic material. Before or after this is done, the flap 42 covering the lower recess 16 is opened and the applicator 22 pried from the lugs 50. Following use, the applicator 22 is replaced and the flap 42 closed.

The disclosed structure has the distinct advantage of presenting a substantially disk-like, flat package which is both aesthetically pleasing and functional in operation. The retention of the applicator is such that it is firmly gripped, and not subject to looseness or rattling in its compartment. The jar and storage device is especially easy to manipulate, thereby lessening the tendency for spillage of the cosmetic contents, or inadvertent dropping of the applicator.

As an alternative to the brush-style applicator 22 which is shown in FIG. 7, a flock-type or sponge applicator can be utilized, with virtually no modification of the mounting arrangement therefor Another embodiment of the invention is shown in FIGS. 10 and 11, wherein like components have been designated by reference numerals corresponding to those of the first embodiment, and with the addition of the suffix "a".

The cosmetic jar and applicator storage device **10*a* shown in FIG. 10 is intended to be used with a powder-puff type applicator; the body 12 of the jar 10*a* is similar to that of FIGS. 1–5, in most respects, except that the depending wall designated 38 in FIG. 2, has been modified to provide an interrupted wall 60, such wall providing a nest area to accommodate the powder puff, shown in dotted outline in FIG. 10, and designated 62**.

The jar of FIG. 10 has a pair of back-to-back shallow recesses 14, **16*a* which are covered by removable cover means 18, 20*a* respectively. The upper recess is defined by the annular wall 24 and transverse bottom wall 26. The lower recess is similarly formed but by a second annular wall or depending peripheral skirt 28*a***.

By the present invention the cover means **20*a* for the lower recess 16*a* comprises an anchorage portion including a flat wall 32*a*, an upstanding interrupted wall 64, FIG. 11, and a semicircular wall 66, to form a structure which is telescopically fitted into the wall structure comprising the skirt 28*a* and interrupted wall 60 of the body; the cover means further comprises a modified closure flap 42*a* connected to the anchorage portion by a thin, polyolefin resilient integral hinge 40*a*. Cooperable detent structures comprising a bead on an upstanding skirt 44*a* of the flap 42*a*, and an internal groove similar to groove 48 of FIGS. 4 and 5 are provided, for holding the flap 42*a* in a normally closed position. There is provided, on the inner surface of both the anchorage portion and flap 42*a*, an interrupted cylinder comprising an upstanding semi-circular flange, constituted of oppositely-disposed, curved wall segments 72 and 74, which have adjacent ends spaced from one another as shown, at the location of the hinge 40*a*. The arrangement is such that the operation of the hinge 40*a* is not affected by the upstanding interrupted semi-circular flange. The upstanding flange thus provides a flat compartment to accommodate the puff-type applicator 62**, which can be either a sponge, or a velour-type puff, depending on the type of cosmetic product with which the jar is used.

Access to the puff applicator 62 is gained by opening the flap **42*a* with one's fingernail, as in the previous embodiment. The puff applicator 62 is removed with the fingers, and following use, is re-inserted in the lower compartment or recess 16*a***, for storage.

The advantages noted above in connection with the first embodiment are retained, namely ease of use, minimal possibility of contamination, and the provision of an aesthetically pleasing external appearance, which enhances the overall attractiveness of the product.

From the above it can be seen that we have provided novel and improved cosmetic jar and applicator storage devices which feature both economy and improved function.

The individual components can be readily molded and assembled, so as to keep the overall fabrication expense as low as possible. The jar is characterized by a flat, disk-like external appearance, which is in keeping with the general configuration of known cosmetic dispensers, aside from the unusual, eye-catching appearance of the jar when it is opened for use.

The devices are thus seen to represent a distinct advance and improvement in the field of cosmetic dispensers.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A molded plastic cosmetic jar and applicator storage device comprising, in combination:

a) a structural body providing a pair of back-to-back shallow recesses which have a common molded plastic wall that seals them from each other, b) completely removable cover means carried by said body and completely removable therefrom, enclosing one of said recesses to retain cosmetic substance therein with a screw-tight seal, and c) a second cover means carried by said body, enclosing the other of said recesses to retain an applicator therein, d) said second cover means having an anchorage portion attached to said body and having a closure flap connected to said anchorage portion by a thin, resilient integral living hinge, e) said closure flap having detent means cooperable with detent means carried by said body, for yieldably holding the flap in a closed position wherein it closes the other of said shallow recesses.

2. A cosmetic jar and storage device as set forth in claim 1, wherein:

a) the second cover means is telescopically press-fitted into the said body.

3. A cosmetic jar and storage device as set forth in claim 2, wherein:

a) the press fit of the body and the second cover means comprises telescopic polygonal-shaped portions of the latter and the body.

4. A cosmetic jar and storage device as set forth in claim 3, wherein:

a) the said telescopic portions comprise an open socket at the under side of the body, and an upstanding open-top enclosure on the second cover means, fitting into the said open socket.

5. A cosmetic jar and storage device as set forth in claim 4, wherein:

a) the socket of the body and the enclosure of the second cover means are circular segments.

6. A cosmetic jar and storage device as set forth in claim 5, wherein:

a) the socket of the body and the enclosure of the second cover means have interfitted straight wall portions, b) said resilient hinge extending along the said straight wall portions.

7. A cosmetic jar and storage device as set forth in claim 1, wherein:

a) said detent means carried by the body is physically an integral part of the body.

8. A cosmetic jar and storage device as set forth in claim 7, wherein:

a) the second cover means has on its periphery a finger tab at the location of the detent means of the body, to facilitate separation of the second cover means from the body.

9. A cosmetic jar and storage device as set forth in claim 1, and further including a cosmetic applicator brush disposed in the said other recess.

10. A cosmetic jar and storage device as set forth in claim 1, and further including means disposed on the upper side of the second cover means, for frictionally holding an applicator.

11. A cosmetic jar and storage device as set forth in claim 10, and further including:

a) an applicator comprising a brush having a handle portion, b) said friction holding means comprising a pair of upstanding tabs engaged With the handle portion of the brush.

12. A cosmetic jar and storage device as set forth in claim 10, wherein:

a) the holding means for an applicator comprises an upstanding arcuate flange carried by the second cover means and adapted to hold a powder puff.

13. A cosmetic Jar and storage device as set forth in claim 1, wherein:

a) said detent means of the closure flap comprises an upstanding crescent-shaped portion of the second cover means, b) said body having a depending peripheral skirt forming the bottom shallow recess thereof, c) said skirt being cooperable with the crescent-shaped portion of the second cover means to effect the retention of the latter in its closed position.

14. A cosmetic jar and storage device as set forth in claim 1, wherein:

a) the second cover means is of circular configuration, b) said resilient living hinge being elongate and extending along a chord of the said circular configuration.

15. A cosmetic jar and storage device as set forth in claim 1, wherein:

a) the said body has an upstanding annular rim portion of substantially U-shaped cross section.

16. A cosmetic jar and storage device as set forth in claim 15, wherein:

a) the said rim portion of the body having the U-shaped cross section has an outer periphery that is provided with means cooperable with the said removable cover means to secure the latter removably to the body.

17. A cosmetic jar and storage device as set forth in claim 16, wherein:

a) the outer periphery of the body rim portion and the removable cover means are provided with continuous threads constituting the securement of the removable cover means.

18. A molded plastic cosmetic jar and applicator storage device comprising, in combination:

a) a structural body providing a pair of back-to-back shallow recesses which have a common molded plastic wall that seals them from each other, b) completely removable cover means carried by said body and completely removable therefrom, said cover means enclosing one of said recesses to retain cosmetic substance therein with a screw-tight seal, and c) a second cover means carried by and cooperable with said body, enclosing the other of said recesses to retain an applicator therein, d) said second cover means and body having telescoping portions by which said second cover means is continuously attached to and held by said body, e) said second cover means including a closure portion defining a support by which a cosmetic applicator can be carried in the other of said recesses and removed therefrom, f) at least a portion of said second cover means being movable with respect to said body and cooperable therewith to either reveal or else conceal the said support defined by the closure portion.

19. A cosmetic jar and applicator storage device comprising, in combination:

a) a structural body providing a pair of back-to-back shallow recesses, b) removable cover means carried by said body, enclosing one of said recesses to retain cosmetic substance therein, c) a second cover means carried by said body, enclosing the other of said recesses to retain an applicator therein, d) said second cover means having an anchorage portion attached to said body and having a closure flap connected to said anchorage portion by a thin, resilient integral hinge, e) said closure flap having detent means cooperable with detent means carried by said body, for yieldably holding the flap in a closed position wherein it closes the other of said shallow recesses, f) means disposed on the upper side of the second cover means, for frictionally holding an applicator, g) said holding means for an applicator comprising an upstanding arcuate flange carried by the second cover means and adapted to hold a powder puff, h) said flange traversing the resilient hinge and having interruptions, i) two of said interruptions of the flange being disposed at the resilient hinge to eliminate any restraint on the action of the hinge.

* * * * *